US010590655B2

(12) United States Patent
Siri

(10) Patent No.: US 10,590,655 B2
(45) Date of Patent: Mar. 17, 2020

(54) RIDGE VENT PROTECTION SYSTEM

(71) Applicant: Anthony Michael Siri, Syracuse, IN (US)

(72) Inventor: Anthony Michael Siri, Syracuse, IN (US)

( * ) Notice: Subject to any disclaimer, the term of this patent is extended or adjusted under 35 U.S.C. 154(b) by 431 days.

(21) Appl. No.: 15/594,934

(22) Filed: May 15, 2017

(65) Prior Publication Data

US 2018/0328040 A1 Nov. 15, 2018

(51) Int. Cl.
*E04D 13/17* (2006.01)
*F24F 7/02* (2006.01)
*F24F 13/08* (2006.01)

(52) U.S. Cl.
CPC ..... *E04D 13/174* (2013.01); *F24F 7/025* (2013.01); *F24F 13/082* (2013.01)

(58) Field of Classification Search
CPC ..... E04D 13/174; F24F 7/025; F24F 13/082
USPC ..... 454/365
See application file for complete search history.

(56) References Cited

U.S. PATENT DOCUMENTS 5,092,086 A * 3/1992 Rognsvoog, Sr. .... E04D 13/076 248/48.1
5,605,022 A * 2/1997 Fulton ..... E04D 13/174 454/365
6,941,706 B2 * 9/2005 Austin ..... E04D 13/004 52/302.3
8,075,376 B1 * 12/2011 Inzeo ..... E04D 13/1478 454/367
9,605,435 B2 * 3/2017 Glick, Jr. ..... E04D 13/174
2001/0052207 A1 * 12/2001 Davis ..... E04D 13/174 52/199
2002/0072324 A1 * 6/2002 Strait ..... E04D 13/174 454/365
2006/0075726 A1 * 4/2006 Yoshimoto ..... B01D 46/0068 55/302
2011/0201266 A1 * 8/2011 Henderson ..... F24F 7/02 454/365

(Continued)

OTHER PUBLICATIONS

Doityourself, Installing Ridge Vent End Cap, Jul. 9, 2010, https://www.doityourself.com/forum/roofing-gutters-all-waterproofing-anywhere/428919-installing-ridge-vent-end-cap.html (Year: 2010).*

(Continued)

*Primary Examiner* — Edelmira Bosques
*Assistant Examiner* — Dana K Tighe
(74) *Attorney, Agent, or Firm* — Botkin & Hall, LLP

(57) ABSTRACT

A ridge vent protection system is made to affix to an existing roof with an existing ridge vent that has an upper surface that is spaced from the existing roof surface. The system attaches to the roof and surrounds the perimeter of the existing ridge vent. The system has elongate members that are attached to the roof adjacent the lateral edges of the existing ridge vent. End caps that affix to the roof that cover the terminal edges of the existing ridge vent. The system is made from perforated metal and has a lower planar portion, an offset portion, and an upper planar portion. The upper planar portion holds down the top surface of the existing ridge vent. An optional top cover is also formed from perforated metal and overlays the entire top surface of the existing ridge vent. It is retained by the elongate members and end caps.

15 Claims, 6 Drawing Sheets

(56) References Cited

U.S. PATENT DOCUMENTS

2013/0344796 A1* 12/2013 Rossetta ..... E04D 13/174
454/365
2014/0357181 A1* 12/2014 Stouffer ..... E04D 13/174
454/367

OTHER PUBLICATIONS

American Animal Control, Ridge-Guard Display, Jan. 18, 2017, https://www.youtube.com/watch?v=hHyjpQPbbx0 (Year: 2017).*

* cited by examiner

RIDGE VENT PROTECTION SYSTEM

BACKGROUND OF THE INVENTION

This present disclosure relates to systems that allow attic ventilation while preventing infestation by unwanted and destructive animals. Attic areas need to be properly vented to prevent mold, moisture, ice, or other problems from stagnant air. There are a few different types of vents typically implemented, such as gable vents, soffit vents, individual roof vents (powered or unpowered), or ridge vents. Each type of vent has its own benefits and drawbacks. Ridge vents are common, where a gap along the peak of the roof is covered by a long vent structure that allows air to escape while keeping rain and debris out. Pests, such as mice, rats, squirrels, and other unwanted animals will seek and exploit any weakness in the exterior of a structure to get shelter from the elements. An attic structure is an ideal location for nesting, due to its protected nature, relatively stable temperature, and available material for bedding. Pests living in an attic space damage the home and allow the buildup of animal waste products, including potential egress into the living space of the home, where the pests can endanger the occupants. A common method for preventing entrance into the structure is to remove the entire ridge vent, secure metal mesh over the existing gap, and then reapply a new ridge vent. This poses several problems, including finding matching shingles, and material cost, and labor cost. An improved protection system is needed.

SUMMARY OF THE INVENTION

The present disclosure describes a barrier system that is installed around an existing ridge vent or with a new ridge vent. The system is formed by a stiff perforated material (typically metal) that is impervious to chewing and destruction by common pests. The system completely surrounds the perimeter of the existing ridge vent. The system includes elongate edge barriers and end caps. The edge barriers have a lower planar portion that is affixed to the roof directly. The lower planar portion extends to an offset portion that bridges the gap between the roof surface and the top surface of the ridge vent. An upper planar portion extends from the offset portion to overlay and hold down the top surface of the ridge vent. As installed, the upper planar portion exerts pressure on the top surface of the ridge vent near the edges. An optional top surface cover extends between opposing elongate edge barriers and end caps to completely cover the top surface of the ridge vent. The optional top surface cover is held down by the elongate edge barriers and end caps. Two different styles of end caps may be incorporated, based on the original installation of the existing ridge vent. If the ridge vent end is flush with the gable end of the roof, the end cap used has a single bend and the vertical portion is affixed to the gable end. If the ridge vent stops short of the roof edge, a set-back end cap has a lower planar portion, an offset portion, and an upper planar portion, similar to the elongate edge barrier. The set-back end cap may have a series of cuts that extend through the lower planar portion and the offset portion to allow the end cap to conform to the curvature of the roof peak and terminal edge of the existing ridge vent.

BRIEF DESCRIPTION OF THE DRAWINGS

A preferred embodiment of this invention has been chosen wherein.

DESCRIPTION OF THE PREFERRED EMBODIMENT

Figure 1:
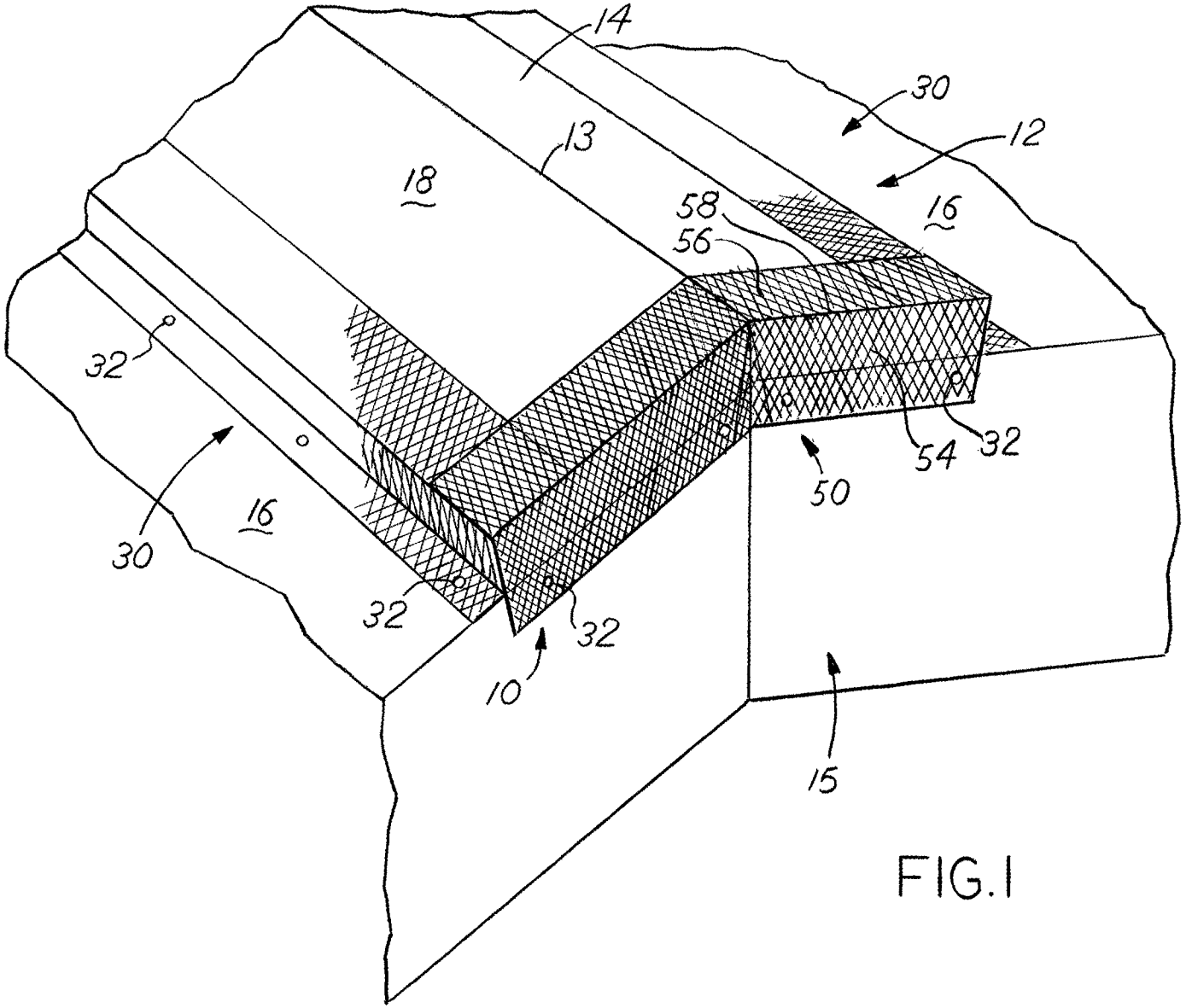
FIG. 1 is a top isometric view of the system as installed onto a ridge vent that is flush with the gable end of a roof.
Figure 2:
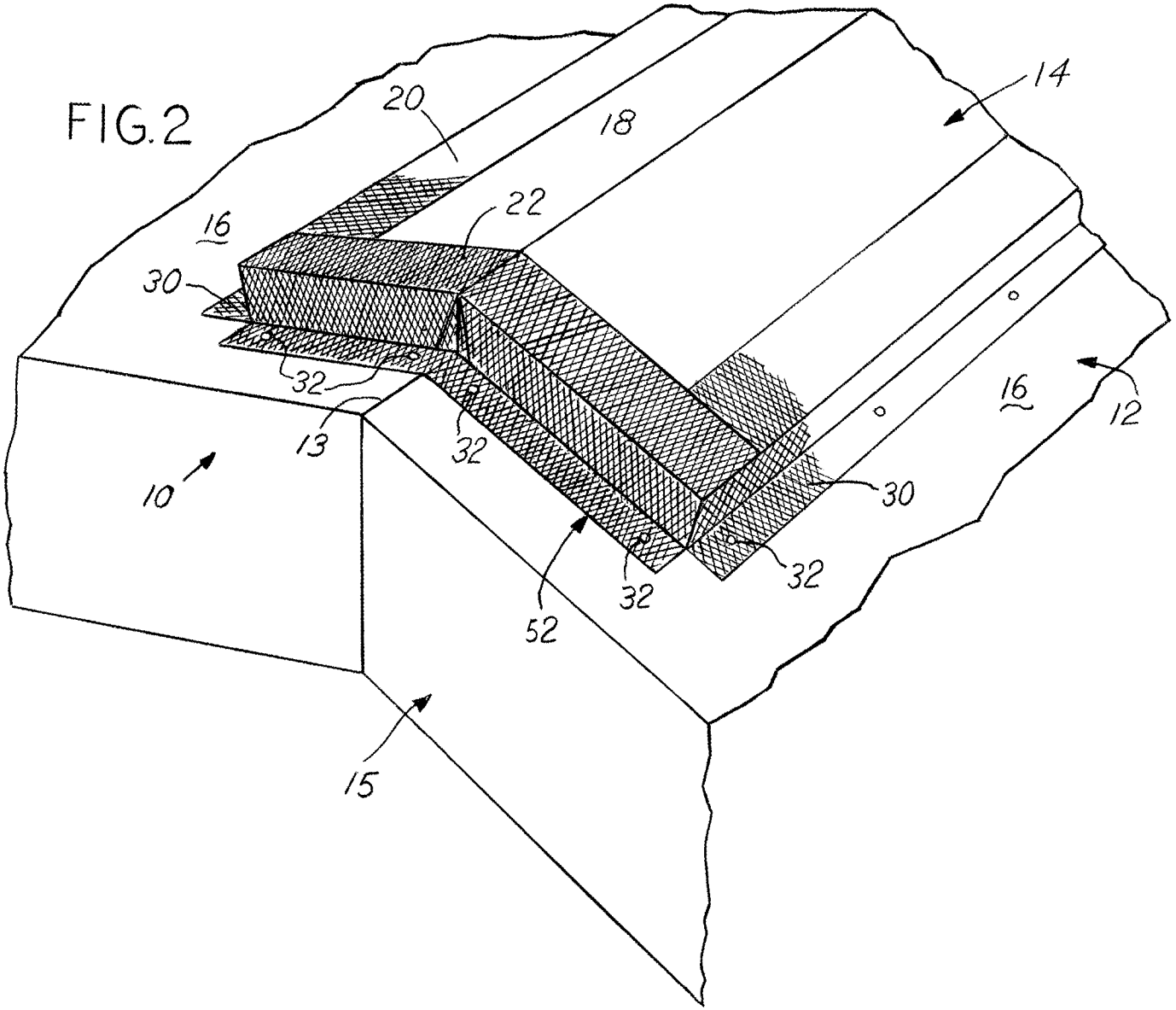
FIG. 2 is a top isometric view of the system as installed onto a ridge vent that is set back from the gable end of a roof.

A ridge protection system 10 is shown in FIG. 1 that is attached to an existing roof 12. The existing roof 12 has a ridge vent 14, which is attached to the roof 12 along the peak 13. The peak 13 terminates at a gable end surface 15. The roof 12 has a shingled surface 16 that is sloped away from the peak 13. The ridge vent 14 overlays the peak 13 and has an upper surface 18 that is spaced from the shingled surface 16. The upper surface 18 is typically shingled similarly to the shingled surface 16. It is contemplated that the upper surface 18 is defined as the upper surface of the ridge vent 14 and there is a shingled surface over the top. The upper surface 18 terminates at lateral edges 20 and terminal edges 22. The ridge vent 14 has a perimeter edge defined by the lateral edges 20 and terminal edges 22. As shown in FIG. 2, the portions of the upper surface 18, particularly near the lateral edges 20, are parallel or nearly parallel to the shingled surface 16. The lateral edges 20 are spaced from the shingled surface 16 to provide an airgap 24 where air can flow to maintain desired attic environmental conditions. Ridge vents 14 are commonly made from plastics or other materials that simplify transportation and installation but may not be durable or impervious to pests, such as rodents, birds, or other invasive and destructive animal. It is common but not required that the roof 12, ridge vent 14, and nearby shingled surface is symmetrical about the peak 13. One side of the roof 12 is a first side and the other side of the roof 12 is a second side.

Figure 3A:
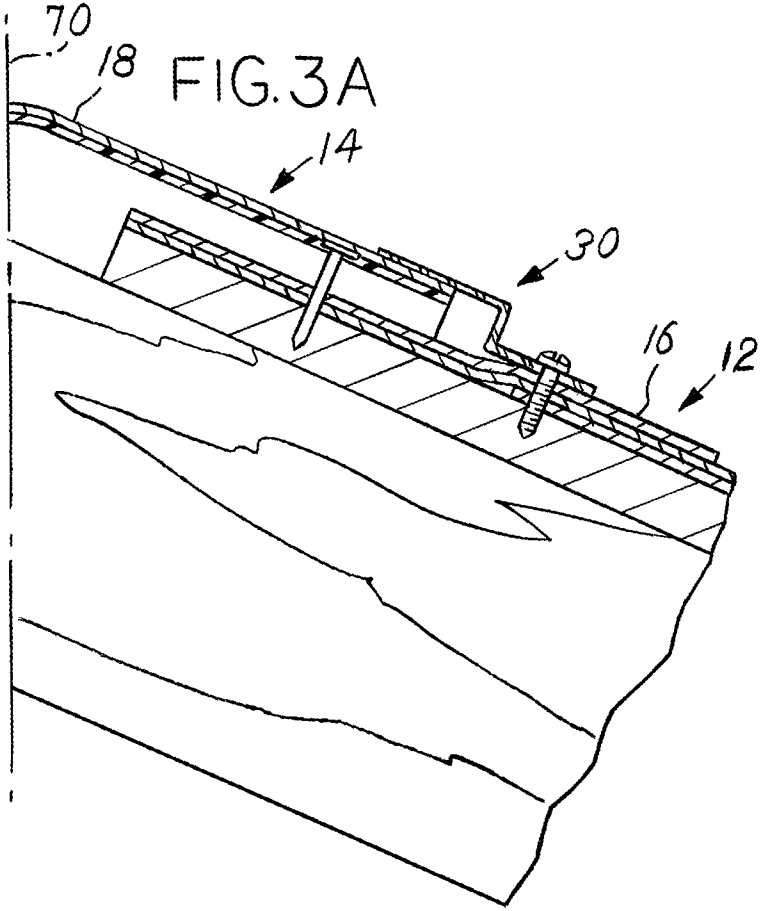
FIG. 3*a* is an end section view of the system as installed onto a ridge vent.
Figure 3:
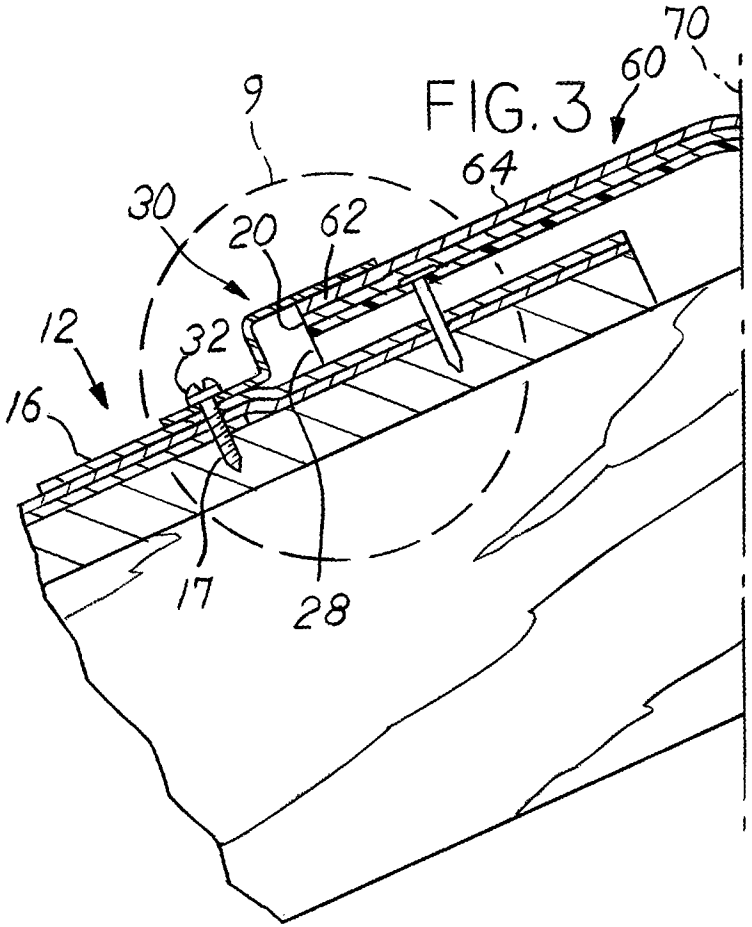
FIG. 3 is an end section view of the system as installed onto a ridge vent and including a top barrier.

The system 10 affixes to the roof 12 as shown in the FIGS. 1-3. The system 10 has an edge barrier 30, formed from perforated or expanded durable material, such as metal. The durable material has some resilient properties but can be bent and formed. It is commonly coated to prevent or reduce corrosion. The perforations 29 allow air, moisture, and liquids to pass through but block items that are larger than the perforations. The system 10 is affixed to the roof 12 using self-sealing fasteners 32. The edge barrier 30 is formed from a single flat sheet with a lower lateral edge 34 and an upper lateral edge 36. The edge barrier 30 has terminal edges 31. A lower planar portion 38 is aligned with a lower plane 39 and extends between the lower lateral edge 34 and a lower bend 40. Located between the lower bend 40 and an upper bend 42 is an offset portion 44, which is aligned with an offset plane 45. Located between the upper bend 42 and the upper lateral edge 36 is an upper planar portion 46 located on an upper plane 47. The width of the upper planar portion 46 is larger than the lower planar portion 38. The larger width of the upper planar portion 46 allows the edge barrier 30 to be set away from the lateral edge 20 while still providing sufficient overlap to the upper surface 18.

When installed, the edge barrier 30, particularly the lower planar portion 38, is affixed to the roof 12 and aligned to be coplanar or mostly coplanar to the shingled surface 16. The offset portion 44 has a width defined by the distance between the lower bend 40 and the upper bend 42. The width of the offset portion 44 corresponds with a tangent distance 28 between the shingled surface 16 and one of the lateral edges 20 of the ridge vent 14. The tangent distance 28 is represented by the distance measured perpendicularly from the shingled surface 16, shown in FIG. 3. The width of the offset portion 44 may be greater than the tangent distance 28.

Figure 5:
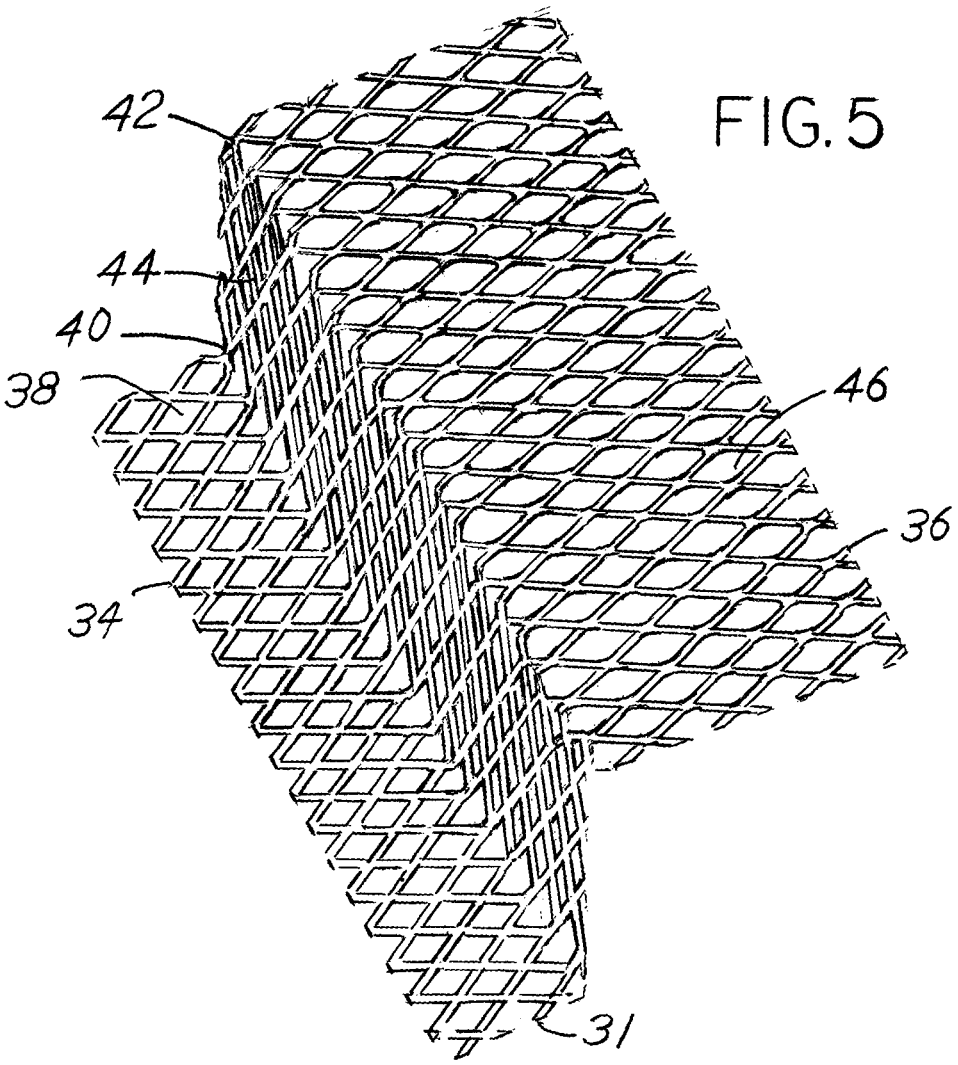
FIG. 5 is an isometric view of the edge barrier shown in FIG. 4.
Figure 4:
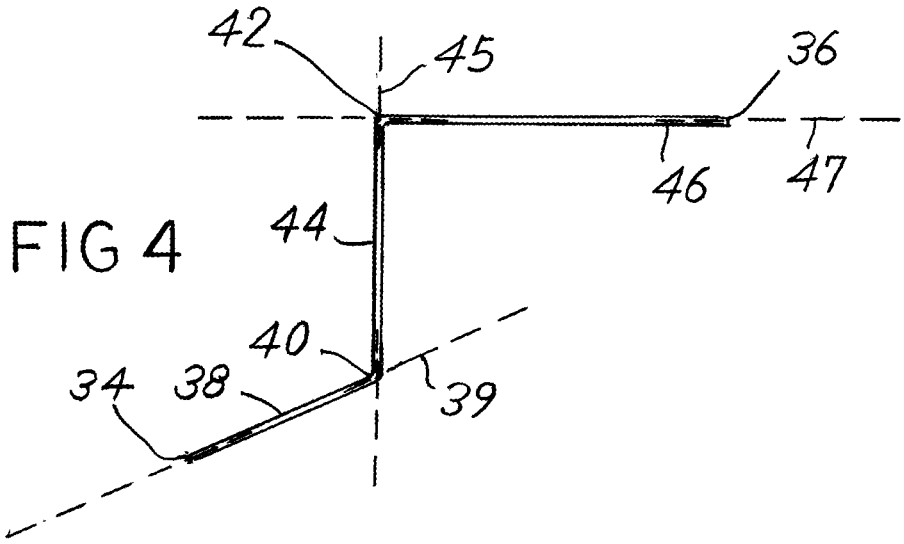
FIG. 4 is an end view of the edge barrier shown in FIG. 1 in the uninstalled state.
Figure 9:
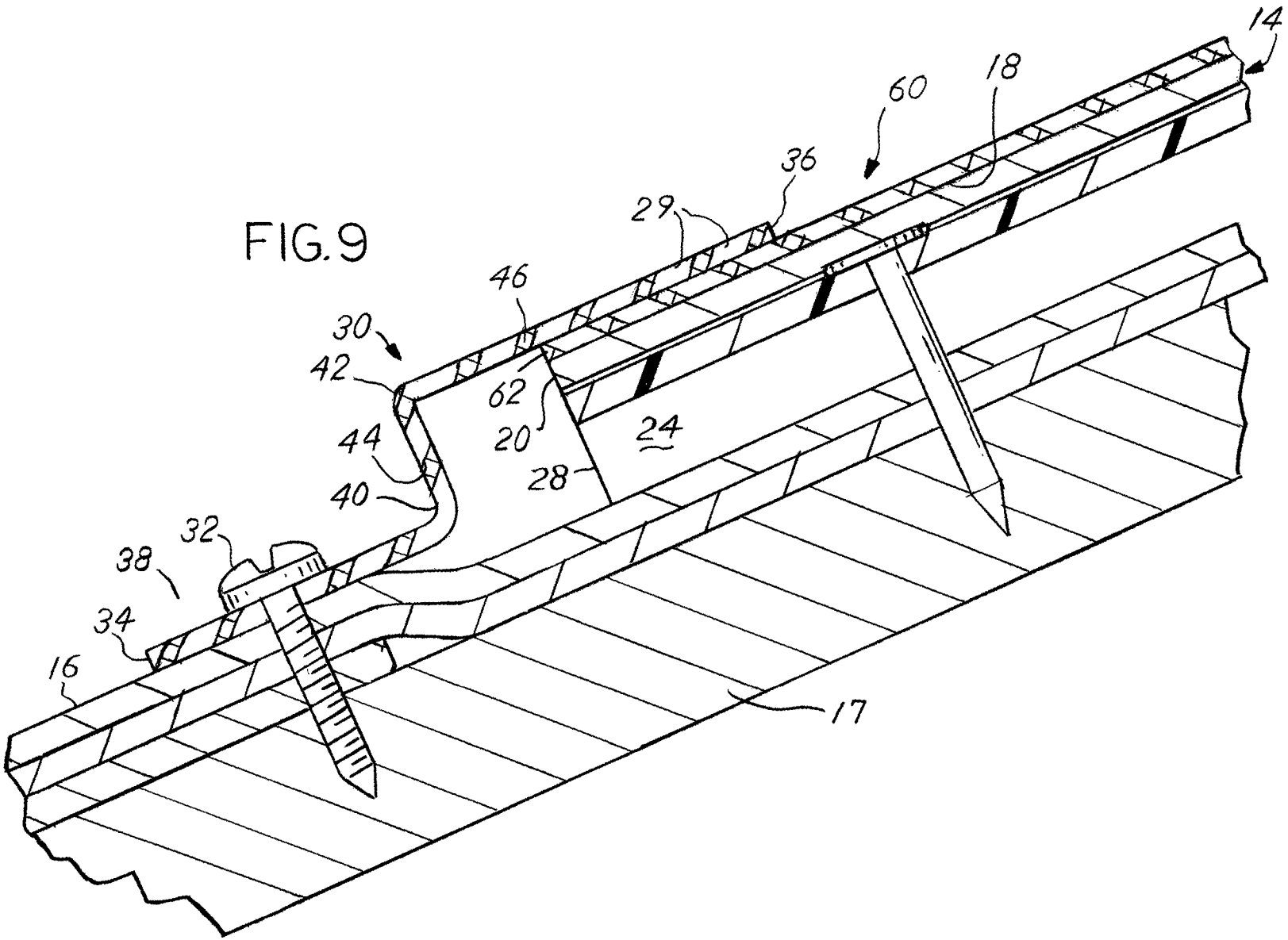
FIG. 9 is partial view 9 of the system shown in FIG. 3.

The edge barrier 30 is shown in an uninstalled state in FIG. 5. As uninstalled, the lower bend 40 is obliquely angled with respect to the offset portion 44 and the lower planar portion 38, and the upper bend 42 is obliquely angled with respect to the offset portion 44 and the upper planar portion 46. As shown in FIG. 4, the upper lateral edge 36 is closer to the lower plane 39 than the upper bend before installation. After installation, the upper lateral edge 36 is moved away from the lower plane 39 and provides biased contact to the upper surface 18. It is contemplated that the biased contact is on the underlying ridge vent 14 with the upper surface 18 covered by shingles. In this state the shingles on the ridge vent would overlay the upper planar portion 46. In the installed state, as shown in FIG. 9, the lower plane 39 is more parallel to the upper plane 47.

Figure 6:
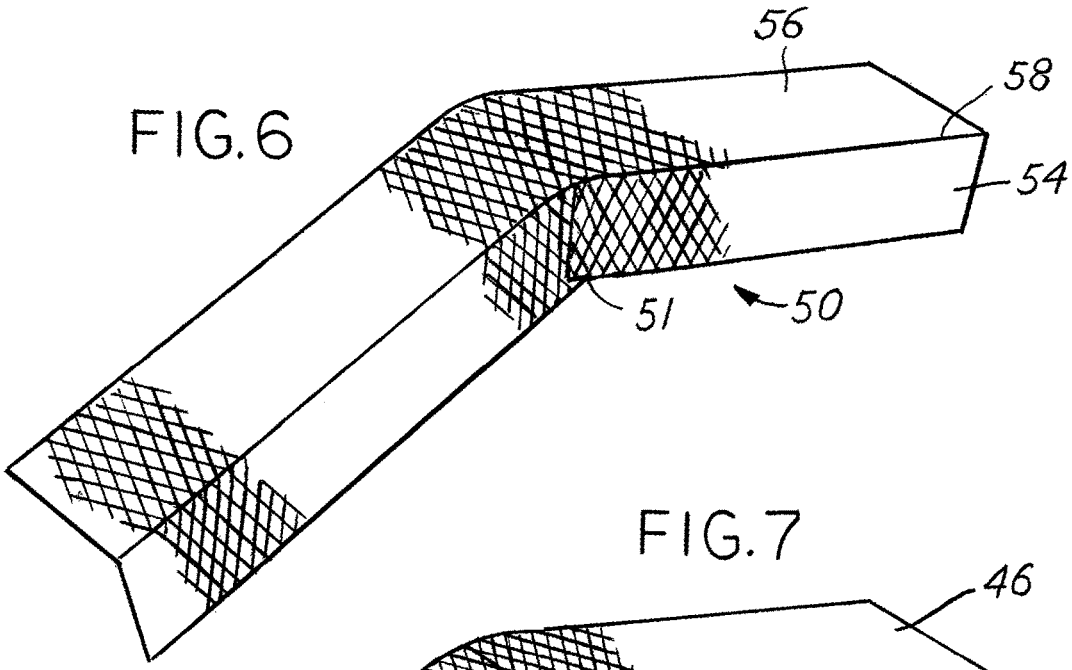
FIG. 6 is an isometric view of the flush end cap as shown in FIG. 1.
Figure 7:
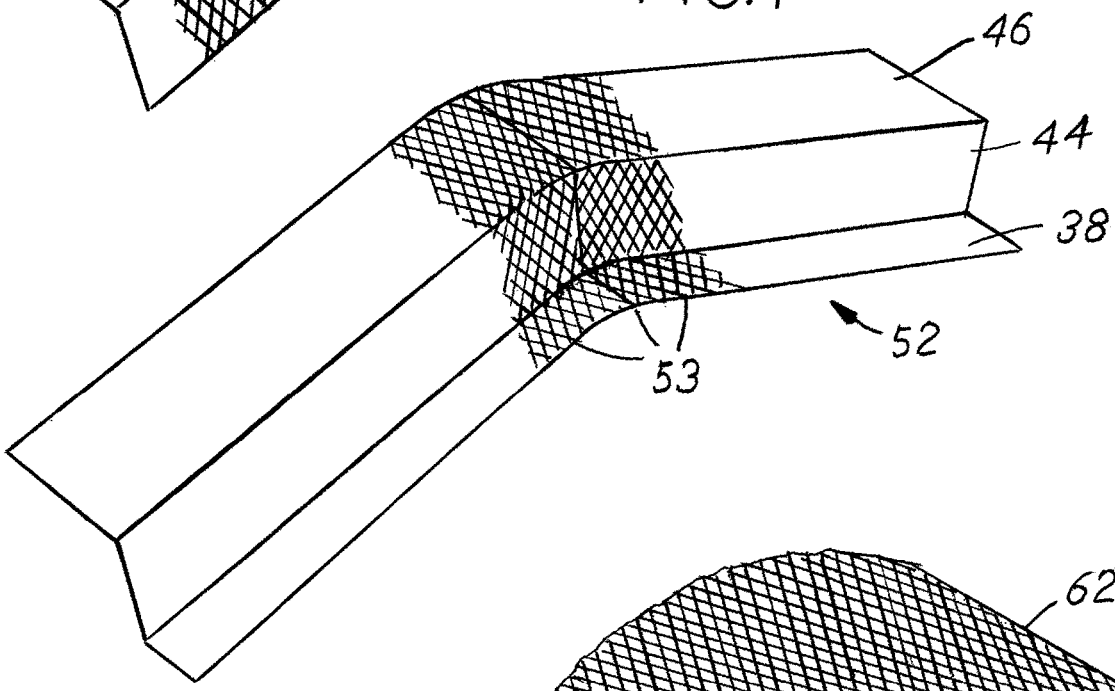
FIG. 7 is an isometric view of a set-back end cap.
Figure 8:
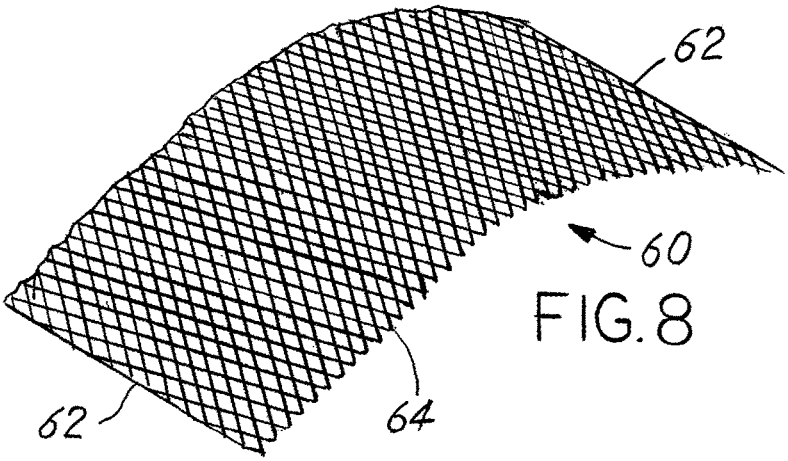
FIG. 8 is an isometric view of a top barrier.

The system 10 includes end caps 50, 52, depending on the installation of the ridge vent 14. The flush end cap 50 is shown in FIG. 6 and the set-back end cap 52 is shown in FIG. 7. If the ridge vent terminal edge 22 is aligned with the gable end surface 15 of the roof 12, as shown in FIG. 1, the flush end cap 50 is used. If the ridge vent terminal edge 22 is located short of the gable end surface 15, set-back end cap 52 is used. Flush end cap 50 has a vertical portion 54 that meets an overlaying portion 56 at a bend 58. To match the pitch and peak of the roof 12 and ridge vent 14, the vertical portion 54 may be cut 51 and overlaid, shown in FIG. 6. The flush end cap 50 is commonly press-formed by the installer to conform the end cap 50 to the roof peak curvature. Press-forming involves the user pressing down on terminal ends of the end cap 50 to permanently bend it. A set-back end cap 52 is formed by taking a portion of the edge barrier 30 and forming it to match the peak 13 of the roof 12. The offset portion 44 is also referred to as the vertical portion for the set-back end cap 52. The upper planar portion 46 of the set-back end cap 52 is also referred to as an overlaying portion. If the roof 12 is steep, the installer may add cuts 53 through the lower planar portion 38 and offset portion 44. The set-back end cap 52 is commonly press-formed by the installer to conform the end cap 52 to the roof peak curvature. This allows the upper planar portion 46 to match the curvature of the upper surface 18. As with the edge barrier 30, the lower planar portion 38 is affixed to the shingled surface 16 with fasteners 32. The installation with the terminal edge 22 of the ridge vent 14 being set back from the gable end surface 15 is shown in FIG. 2.

The end caps 50, 52 are shown as a separate component, but it is contemplated that the edge barrier 30 is curved around to form the end cap or a portion of the end cap. It is contemplated that the edge barrier 30 is bent to form the end cap portion, and then curved again to continue along the opposite side of the ridge vent 14. In this event, the top surface 46 would be cut to allow the edge barrier 30 to curve around.

An optional top barrier 60 may be installed that overlays the upper surface 18 of the ridge vent 14. The top barrier 60 has a perimeter made up of opposing lateral edges 62 and end edges 64. In the uninstalled state, the top barrier 60 may be curved or flat. As installed, it closely conforms to the upper surface 18. In FIG. 3, a section view of an example installation is shown with the top barrier 60 shown. FIGS. 3 and 3*a* are separated by a break line 70, with the left side of the break line 70 showing the top barrier 60 installed (FIG. 3). The break line 70 is imaginary and only to demonstrate alternative installations in a single view. The right side of the break line 70 shows the installation of the system 10 without the optional top barrier 60 (FIG. 3*a*). In an installation a top barrier 60, the lateral edges 62 would be adjacent the lateral edges 20 of the ridge vent 14. If the optional top barrier 60 is used, when the edge barrier 30 is installed, the upper lateral edge 36 is in biased contact with the optional top barrier 60. The perimeter of the top barrier 60 is retained by the edge barriers 30 and end caps 50, 52.

As installed, the upper lateral edge 36 of the edge barrier 30 applies a biasing force to the upper surface 18 of the ridge vent 14. Further, the additional width of the upper planar portion 46 allows the edge barrier 30 to be installed with the upper bend 42 spaced from the lateral edge 20, shown in FIG. 3. This allows airflow through the part of the upper planar portion 46 in addition to the offset portion 44. If the optional top barrier 60 is installed (as is shown on the left side of FIG. 3, the upper lateral edge 36 of the edge barrier 30 applies biasing force to portions of the top barrier 60 to retain it and maintain contact with the upper surface 18.

To install the system 10, any damaged or missing components on the roof 12 or ridge vent 14 are repaired or replaced. Optionally, the top barrier 60 is installed with lateral edges 62 being located next to lateral edges 20 of the ridge vent 14. The top barrier 60 will overlay the entire upper surface 18 and extend to the terminal edges 22. Next, the edge barriers 30 are positioned with the terminal edge 31 aligned with the terminal edge 22 of the existing ridge vent 14. The lateral edge 20 located between the upper bend 42 and upper lateral edge 36. Fasteners 32 are driven through the lower planar portion 38, through the shingled surface 16 and into the roof structure, such as roof decking 17. The edge barriers 30 are installed with terminal edges 31 aligned with terminal edges 22 of the ridge vent 14. Multiple edge barriers 30 may be installed to cover the entire lateral edge 20 of the ridge vent 14. Edge barriers 30 are installed over both lateral edges 20, as shown in the FIGS. 1-3. Once all of the edge barriers 30 are installed, the installer will choose which end cap 50, 52 is more appropriate. The flush end cap 50 is selected if the terminal edge 22 is aligned with the gable end surface 15, as is shown in FIG. 1. The installer will trim the length and add cuts 51 through the vertical portion 54 to bend or curve the overlaying portion to conform to the upper surface 18. The length is chosen to align terminal ends of the flush end cap 50 are aligned or nearly aligned with the lateral edges 20 of the ridge vent 14. The installer then uses fasteners 32 through the gable end surface 15. For the set-back end cap 52, the installer may add cuts 53 through the lower planar portion 38 and offset portion 44 to conform the upper planar portion 46 to match the curvature or profile of the upper surface 18. As with the edge barriers 30, fasteners 32 are driven through the lower planar portion 38 through the shingled surface 16 and into the roof decking 17. Ends of the end caps 50, 52 may be bent to be interlocked with the terminal ends of the edge barriers 30. Once installed, the system 10 will overlay the entire perimeter of the ridge vent 14.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A ridge vent pest protection system in combination with a roof having a first shingled surface having a lateral top edge and a second shingled surface having a lateral top edge, said top lateral edges of said first and second shingled surface separated by a gap, said roof having a ridge vent overlaying said gap, said ridge vent being an elongate member having a first lateral edge located above said first shingled surface and an oppositely located second lateral edge located above said second shingled surface, said ridge vent having a first terminal edge and an oppositely located second terminal edge, said terminal edges connecting said first lateral edge and said second lateral edge to form a perimeter, said ridge vent having a top surface extending between said first and said second lateral edges and said first and second terminal edges, a first portion of said top surface spaced from and substantially parallel with said first shingled surface, a second portion of said top surface spaced from and substantially parallel to said second shingled surface, said system comprising:

a first elongate edge barrier having a first lower lateral edge and an oppositely located first upper lateral edge, said first edge barrier formed of a first flat material having a plurality of apertures extending therethrough, said first edge barrier having a first lower planar portion located on a first lower plane and extending from said first lower lateral edge to a first lower bend, a first offsetting portion located on a first offset plane and extending from said first lower bend to a first upper bend, a first upper planar portion located on a first upper plane and extending from said first upper bend to said first upper lateral edge, said first lower planar portion having a width defined by a first distance between said first lower lateral edge and said first lower bend, said first upper planar portion having a width defined by a second distance between said first upper lateral edge and said first upper bend, said second distance being greater than said first distance, said first elongate edge barrier having an uninstalled state where said first lower planar portion is obliquely angled with respect to said first upper planar portion;

a second elongate edge barrier having a second lower lateral edge and an oppositely located second upper lateral edge, said second edge barrier formed of a second flat material having a plurality of apertures extending therethrough, said second edge barrier having a second lower planar portion located on a second lower plane and extending from said second lower lateral edge to a second lower bend, a second offsetting portion located on a second offset plane and extending from said second lower bend to a second upper bend, a second upper planar portion located on a second upper plane and extending from said second upper bend to said second upper lateral edge, said second lower planar portion having a width defined by a first distance between said second lower lateral edge and said second lower bend, said second upper planar portion having a width defined by a second distance between said second upper lateral edge and said second upper bend, said second distance being greater than said first distance, said second elongate edge barrier having an uninstalled state where said second lower planar portion is obliquely angled with respect to said second upper planar portion;

a first end cap having a first overlaying portion in biased contact with a portion of said top surface adjacent said first terminal edge and extending between said first and said second lateral edge of said ridge vent;

a second end cap having a second overlaying portion in biased contact with a portion of said top surface adjacent said second terminal edge and extending between said first and said second lateral edge of said ridge vent;

said first elongate edge barrier having an installed state wherein a first fastener extends through said first lower planar portion and said first shingled surface, said installed state maintaining said first upper planar portion in biased contact with said top surface of said ridge vent when said first fastener affixes said first lower planar portion to said first shingled surface, said second elongate edge barrier having an installed state wherein a second fastener extends through said second lower planar portion and said second shingled surface, said installed state maintaining said second upper planar portion in biased contact with said top surface of said ridge vent when said second fastener affixes said second lower planar portion to said second shingled surface;

when said first terminal edge of said ridge vent is substantially aligned with a gable end wall, said first end cap is a flush gable end cap formed of a material plurality of apertures, said first end cap having a vertical portion and an overlaying portion, said vertical portion affixed to said gable end wall, said overlaying portion overlaying said first terminal edge of said ridge vent; and said first and said second elongate edge barriers and said first and second end caps surrounding and overlaying said perimeter of said ridge vent.

2. The protection system of claim 1, further comprising a top barrier overlaying said top surface of said ridge vent, said top barrier being made from material having a plurality of apertures extending therethrough.

3. A ridge vent pest protection system in combination with a roof having a shingled surface having a peak, said roof having a ridge vent overlaying said peak, said ridge vent being an elongate member having a lateral edge located above said shingled surface, said ridge vent having a terminal edge intersecting said lateral edge, said ridge vent having a top surface extending from said terminal edge and said lateral edge, a portion of said top surface spaced above and substantially parallel with said shingled surface, said system comprising:

an elongate edge barrier having a lower lateral edge and an oppositely located upper lateral edge, said edge barrier formed of a sheet of perforated material, said edge barrier having a lower planar portion located on a lower plane and extending from said lower lateral edge to a lower bend, an offsetting portion extending from said lower bend to an upper bend, and an upper planar portion located on an upper plane and extending from said upper bend to said upper lateral edge, said lower planar portion having a width defined by a first distance between said lower lateral edge and said lower bend, said upper planar portion having a width defined by a second distance between said upper lateral edge and said upper bend, said second distance being greater than said first distance, said elongate edge barrier having an uninstalled state where said lower planar portion is obliquely angled with respect to said upper planar portion;

an end cap having an overlaying portion in biased contact with a portion of said top surface adjacent said terminal edge when said terminal edge of said ridge vent is substantially aligned with a gable end wall, said system further comprising a flush gable end barrier formed of said sheet of perforated material, said end barrier having a vertical portion and an overlaying portion, said vertical portion affixed to said gable end wall, said overlaying portion overlaying said terminal edge of said ridge vent; and said elongate edge barrier having an installed state wherein a fastener extends through said lower planar portion and said shingled surface, said installed state maintaining said upper planar portion in biased contact with said top surface of said ridge vent when said fastener affixes said lower planar portion to said shingled surface.

4. The protection system of claim 3, further comprising a top barrier overlaying said top surface of said ridge vent.

5. The protection system of claim 4, wherein said top barrier is formed of a sheet of material having a plurality of apertures extending therethrough.

6. A ridge vent pest protection system in combination with a roof having a peak located between a lateral top edge of a first shingled surface and a lateral top edge of a second shingled surface, said roof having a ridge vent overlaying said top lateral edges of said first and second shingled surfaces, said ridge vent being an elongate member having a first lateral edge located above said first shingled surface and an oppositely located second lateral edge located above said second shingled surface, said ridge vent having a first terminal edge and an oppositely located second terminal edge, said terminal edges connecting said first lateral edge and said second lateral edge to form a perimeter, said perimeter defining a top surface of said ridge vent, a first portion of said top surface spaced above and substantially parallel with said first shingled surface, a second portion of said top surface spaced above and substantially parallel to said second shingled surface, said system comprising:

an elongate edge barrier having a lower lateral edge and an oppositely located upper lateral edge, said edge barrier formed of a sheet of perforated material, said edge barrier having a lower planar portion located on a lower plane and extending from said lower lateral edge to a lower bend, an offsetting portion extending from said lower bend to an upper bend, and an upper planar portion located on an upper plane and extending from said upper bend to said upper lateral edge, said lower planar portion having a width defined by a first distance between said lower lateral edge and said lower bend, said upper planar portion having a width defined by a second distance between said upper lateral edge and said upper bend, said second distance being greater than said first distance, said elongate edge barrier having an uninstalled state where said lower planar portion is obliquely angled with respect to said upper planar portion;

an end cap formed of a sheet of perforated material and having an overlaying portion and a vertical portion, each said overlaying portion of said end cap in biased contact with a corresponding portion of said top surface adjacent a corresponding said first or second terminal edge when said end caps are affixed to said roof;

when said terminal edge of said ridge vent is substantially aligned with a gable end wall, said system further comprising a flush gable end barrier formed of said sheet of perforated material, said end barrier having a vertical portion and an overlaying portion, said vertical portion affixed to said gable end wall, said overlaying portion overlaying said first or second terminal edge of said ridge vent; and said elongate edge barrier having an installed state wherein a fastener extends through said lower planar portion and said first or second shingled surface, said installed state maintaining said upper planar portion in biased contact with said top surface of said ridge vent when said fastener affixes said lower planar portion to said first or second shingled surface, said upper planar portion overlaying said lateral edge of said ridge vent.

7. The protection system of claim 6, further comprising a top barrier overlaying said top surface of said ridge vent, lateral edges of said top barrier being located between said top surface of said ridge vent and said upper planar portion.

8. The protection system of claim 7, wherein said top barrier is formed of a sheet of material having a plurality of apertures extending therethrough.

9. A ridge vent pest protection system in combination with a roof having a first shingled surface having a lateral top edge and a second shingled surface having a lateral top edge, said top lateral edges of said first and second shingled surface separated by a gap, said roof having a ridge vent overlaying said gap, said ridge vent being an elongate member having a first lateral edge located above said first shingled surface and an oppositely located second lateral edge located above said second shingled surface, said ridge vent having a first terminal edge and an oppositely located second terminal edge, said terminal edges connecting said first lateral edge and said second lateral edge to form a perimeter, said ridge vent having a top surface extending between said first and said second lateral edges and said first and second terminal edges, a first portion of said top surface spaced from and substantially parallel with said first shingled surface, a second portion of said top surface spaced from and substantially parallel to said second shingled surface, said system comprising:

a first elongate edge barrier having a first lower lateral edge and an oppositely located first upper lateral edge, said first edge barrier formed of a first flat material having a plurality of apertures extending therethrough, said first edge barrier having a first lower planar portion located on a first lower plane and extending from said first lower lateral edge to a first lower bend, a first offsetting portion located on a first offset plane and extending from said first lower bend to a first upper bend, a first upper planar portion located on a first upper plane and extending from said first upper bend to said first upper lateral edge, said first lower planar portion having a width defined by a first distance between said first lower lateral edge and said first lower bend, said first upper planar portion having a width defined by a second distance between said first upper lateral edge and said first upper bend, said second distance being greater than said first distance, said first elongate edge barrier having an uninstalled state where said first lower planar portion is obliquely angled with respect to said first upper planar portion;

a second elongate edge barrier having a second lower lateral edge and an oppositely located second upper lateral edge, said second edge barrier formed of a second flat material having a plurality of apertures extending therethrough, said second edge barrier having a second lower planar portion located on a second lower plane and extending from said second lower lateral edge to a second lower bend, a second offsetting portion located on a second offset plane and extending from said second lower bend to a second upper bend, a second upper planar portion located on a second upper plane and extending from said second upper bend to said second upper lateral edge, said second lower planar portion having a width defined by a first distance between said second lower lateral edge and said second lower bend, said second upper planar portion having a width defined by a second distance between said second upper lateral edge and said second upper bend, said second distance being greater than said first distance, said second elongate edge barrier having an uninstalled state where said second lower planar portion is obliquely angled with respect to said second upper planar portion;

a first end cap having a first overlaying portion in biased contact with a portion of said top surface adjacent said first terminal edge and extending between said first and said second lateral edge of said ridge vent;

a second end cap having a second overlaying portion in biased contact with a portion of said top surface adjacent said second terminal edge and extending between said first and said second lateral edge of said ridge vent;

said first elongate edge barrier having an installed state wherein a first fastener extends through said first lower planar portion and said first shingled surface, said installed state maintaining said first upper planar portion in biased contact with said top surface of said ridge vent when said first fastener affixes said first lower planar portion to said first shingled surface, said second elongate edge barrier having an installed state wherein a second fastener extends through said second lower planar portion and said second shingled surface, said installed state maintaining said second upper planar portion in biased contact with said top surface of said ridge vent when said second fastener affixes said second lower planar portion to said second shingled surface;

when said first terminal edge of said ridge vent is set back from a gable end wall, said first end cap is a set-back end cap, said set-back end cap formed from a portion of said elongate member, said upper planar portion overlaying said first terminal edge of said ridge vent; and said first and said second elongate edge barriers and said first and second end caps surrounding and overlaying said perimeter of said ridge vent.

10. The protection system of claim 9, said set-back end cap further comprising cuts through a lower planar portion and an offsetting portion.

11. The protection system of claim 9, further comprising a top barrier overlaying said top surface of said ridge vent, said top barrier being made from material having a plurality of apertures extending therethrough.

12. A ridge vent pest protection system in combination with a roof having a shingled surface having a peak, said roof having a ridge vent overlaying said peak, said ridge vent being an elongate member having a lateral edge located above said shingled surface, said ridge vent having a terminal edge intersecting said lateral edge, said ridge vent having a top surface extending from said terminal edge and said lateral edge, a portion of said top surface spaced above and substantially parallel with said shingled surface, said system comprising:

an elongate edge barrier having a lower lateral edge and an oppositely located upper lateral edge, said edge barrier formed of a sheet of perforated material, said edge barrier having a lower planar portion located on a lower plane and extending from said lower lateral edge to a lower bend, an offsetting portion extending from said lower bend to an upper bend, and an upper planar portion located on an upper plane and extending from said upper bend to said upper lateral edge, said lower planar portion having a width defined by a first distance between said lower lateral edge and said lower bend, said upper planar portion having a width defined by a second distance between said upper lateral edge and said upper bend, said second distance being greater than said first distance, said elongate edge barrier having an uninstalled state where said lower planar portion is obliquely angled with respect to said upper planar portion;

an end cap having an overlaying portion in biased contact with a portion of said top surface adjacent said terminal edge when said terminal edge of said ridge vent is set back from a gable end wall, said system further comprising a set-back end cap, said set-back end cap formed from a portion of said elongate member and including cuts through said lower planar portion and said offset portion, said upper planar portion overlaying said terminal edge of said ridge vent; and said elongate edge barrier having an installed state wherein a fastener extends through said lower planar portion and said shingled surface, said installed state maintaining said upper planar portion in biased contact with said top surface of said ridge vent when said fastener affixes said lower planar portion to said shingled surface.

13. The protection system of claim 12, further comprising a top barrier overlaying said top surface of said ridge vent.

14. A ridge vent pest protection system in combination with a roof having a peak located between a lateral top edge of a first shingled surface and a lateral top edge of a second shingled surface, said roof having a ridge vent overlaying said top lateral edges of said first and second shingled surfaces, said ridge vent being an elongate member having a first lateral edge located above said first shingled surface and an oppositely located second lateral edge located above said second shingled surface, said ridge vent having a first terminal edge and an oppositely located second terminal edge, said terminal edges connecting said first lateral edge and said second lateral edge to form a perimeter, said perimeter defining a top surface of said ridge vent, a first portion of said top surface spaced above and substantially parallel with said first shingled surface, a second portion of said top surface spaced above and substantially parallel to said second shingled surface, said system comprising:

an elongate edge barrier having a lower lateral edge and an oppositely located upper lateral edge, said edge barrier formed of a sheet of perforated material, said edge barrier having a lower planar portion located on a lower plane and extending from said lower lateral edge to a lower bend, an offsetting portion extending from said lower bend to an upper bend, and an upper planar portion located on an upper plane and extending from said upper bend to said upper lateral edge, said lower planar portion having a width defined by a first distance between said lower lateral edge and said lower bend, said upper planar portion having a width defined by a second distance between said upper lateral edge and said upper bend, said second distance being greater than said first distance, said elongate edge barrier having an uninstalled state where said lower planar portion is obliquely angled with respect to said upper planar portion;

an end cap formed of a sheet of perforated material and having an overlaying portion and a vertical portion, each said overlaying portion of said end cap in biased contact with a corresponding portion of said top surface adjacent a corresponding said first or second terminal edge when said end caps are affixed to said roof;

when said terminal edge of said ridge vent is set back from a gable end wall, said system further comprising a set-back end cap, said set-back end cap formed from a portion of said elongate member and including cuts through said lower planar portion and said offset portion, said upper planar portion overlaying said terminal edge of said ridge vent; and said elongate edge barrier having an installed state wherein a fastener extends through said lower planar portion and said first or second shingled surface, said installed state maintaining said upper planar portion in biased contact with said top surface of said ridge vent when said fastener affixes said lower planar portion to said first or second shingled surface, said upper planar portion overlaying said lateral edge of said ridge vent.

15. The protection system of claim 14, further comprising a top barrier overlaying said top surface of said ridge vent.

* * * * *